US012146370B2

(12) United States Patent
Zhang et al.

(10) Patent No.: US 12,146,370 B2
(45) Date of Patent: Nov. 19, 2024

(54) CUTTER WITH EDGE DURABILITY

(71) Applicant: Schlumberger Technology Corporation, Sugar Land, TX (US)

(72) Inventors: Youhe Zhang, Spring, TX (US); Xiaoge Gan, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 124 days.

(21) Appl. No.: 17/763,225

(22) PCT Filed: Sep. 25, 2020

(86) PCT No.: PCT/US2020/070582
§ 371 (c)(1),
(2) Date: Mar. 24, 2022

(87) PCT Pub. No.: WO2021/062443
PCT Pub. Date: Apr. 1, 2021

(65) Prior Publication Data

US 2022/0397006 A1 Dec. 15, 2022

Related U.S. Application Data

(60) Provisional application No. 62/906,153, filed on Sep. 26, 2019.

(51) Int. Cl.
*E21B 10/567* (2006.01)
*E21B 10/42* (2006.01)

(52) U.S. Cl.
CPC ..... *E21B 10/5673* (2013.01); *E21B 10/5676* (2013.01); *E21B 10/42* (2013.01)

(58) Field of Classification Search
CPC .. E21B 10/5673; E21B 10/5676; E21B 10/42; E21B 10/26; E21B 10/55; E21B 10/633
See application file for complete search history.

(56) References Cited

U.S. PATENT DOCUMENTS 6,196,340 B1 * 3/2001 Jensen ..... E21B 10/52 175/431
8,037,951 B2 10/2011 Shen et al.
8,113,303 B2 2/2012 Zhang et al.
(Continued)

OTHER PUBLICATIONS

International Search Report and Written Opinion issued in International Patent application PCT/US2020/070582 on Dec. 30, 2020, 12 pages.

(Continued)

*Primary Examiner* — Brad Harcourt
(74) *Attorney, Agent, or Firm* — Bryan K. Adams

(57) ABSTRACT

A cutting element has a cutting face with a geometry including at least one protrusion spaced a radial distance apart from an edge of the cutting element, the edge extending around an entire periphery of the cutting face, and a lower portion extending within the distance between the at least one protrusion and the edge, wherein a lower portion axial height measured between the edge and a base of the at least one protrusion is less than 30 percent of a greatest axial height of the at least one protrusion measured between the base of the at least one protrusion and an axially highest point of the at least one protrusion.

19 Claims, 10 Drawing Sheets

(56) References Cited

U.S. PATENT DOCUMENTS

| | | | | |
|---|---|---|---|---|
| 8,210,288 | B2 * | 7/2012 | Chen | E21B 10/55 175/420.1 |
| 9,404,310 | B1 * | 8/2016 | Sani | E21B 10/55 |
| 10,125,552 | B2 | 11/2018 | Zhao et al. | |
| 10,287,815 | B2 | 5/2019 | Kitamura et al. | |
| 2001/0040053 | A1 | 11/2001 | Beuershausen | |
| 2003/0111273 | A1 | 6/2003 | Richert et al. | |
| 2005/0247492 | A1 | 11/2005 | Shen | |
| 2005/0269139 | A1 | 12/2005 | Shen et al. | |
| 2014/0182947 | A1 | 7/2014 | Bhatia | |
| 2014/0284117 | A1 | 9/2014 | Patel | |
| 2015/0047912 | A1 * | 2/2015 | Pettiet | E21B 10/62 175/428 |
| 2016/0356093 | A1 | 12/2016 | Patel et al. | |
| 2017/0234078 | A1 * | 8/2017 | Patel | E21B 10/55 175/430 |
| 2018/0274303 | A1 | 9/2018 | Song | |
| 2019/0040689 | A1 | 2/2019 | Liang et al. | |
| 2019/0112877 | A1 * | 4/2019 | Gan | E21B 10/54 |

OTHER PUBLICATIONS

International Preliminary Report on Patentability issued in International Patent application PCT/US2020/070582, dated Apr. 7, 2022, 7 pages.

* cited by examiner

CUTTER WITH EDGE DURABILITY

CROSS-REFERENCE TO RELATED APPLICATIONS

This application is the U.S. national phase of International Patent Application No. PCT/US2020/070582, filed Sep. 25, 2020, and entitled "Cutter with Edge Durability." which claims the benefit of, and priority to, U.S. Patent Application No. 62/906,153 filed on Sep. 26, 2019, which is incorporated in its entirety herein by this reference.

BACKGROUND

Cutting elements used in down-hole drilling operations are often made with a super hard material layer to penetrate hard and abrasive earthen formations. For example, cutting elements may be mounted to drill bits (e.g., rotary drag bits), such as by brazing, for use in a drilling operation. FIG. 1 shows an example of a fixed cutter drill bit 10 (sometimes referred to as a drag bit) having a plurality of cutting elements 18 mounted thereto for drilling a formation. The drill bit 10 includes a bit body 12 having an externally threaded connection at one end 14, and a plurality of blades 16 extending from the other end of bit body 12 and forming the cutting surface of the bit 10. A plurality of cutters 18 are attached to each of the blades 16 and extend from the blades to cut through earth formations when the bit 10 is rotated during drilling. The cutters 18 may deform the earth formation by scraping and shearing.

Super hard material layers of a cutting element may be formed under high temperature and pressure conditions, usually in a press apparatus designed to create such conditions, cemented to a carbide substrate containing a metal binder or catalyst such as cobalt. For example, polycrystalline diamond (PCD) is a super hard material used in the manufacture of cutting elements, where PCD cutters typically comprise diamond material formed on a supporting substrate (typically a cemented tungsten carbide (WC) substrate) and bonded to the substrate under high temperature, high pressure (HTHP) conditions.

A PCD cutting element may be fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond grain layers are then compressed under HPHT conditions which promotes a sintering of the diamond grains to form a polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce may result in spalling, delamination, or fracture of the super hard material layer or the substrate thereby reducing or eliminating the cutting elements efficacy and decreasing overall drill bit wear life.

SUMMARY

In one aspect, embodiments of the present disclosure relate to cutting elements having a cutting face with a geometry including at least one protrusion spaced a radial distance apart from an edge of the cutting element, the edge extending around an entire periphery of the cutting face, and a lower portion extending within the distance between the at least one protrusion and the edge, wherein a lower portion axial height measured between the edge and a base of the at least one protrusion is less than 30 percent of a greatest axial height of the at least one protrusion measured between the base of the at least one protrusion and an axially highest point of the at least one protrusion.

In another aspect, embodiments of the present disclosure relate to cutting elements having a body, a diamond table disposed at a cutting end of the body, and a cutting face formed on the diamond table at the cutting end, the cutting face having a geometry including a planar portion and at least one protrusion raised from the planar portion, wherein the planar portion entirely surrounds the at least one protrusion.

In yet another aspect, embodiments of the present disclosure relate to cutting elements having a cutting face formed at its cutting end and a chamfer formed around the periphery of the cutting face, wherein the cutting face has at least one protrusion spaced a radial distance apart from an inner diameter of the chamfer.

Other aspects and advantages of the invention will be apparent from the following description and the appended claims.

DETAILED DESCRIPTION

Embodiments of the present disclosure generally relate to cutting elements, which may be mounted to drill bits for drilling earthen formations or other cutting tools. Cutting elements disclosed herein may include a cutting face geometry designed to improve the durability of the cutting element and maintain higher rock cutting efficiency. The cutting face geometry may include at least one protrusion or ridge spaced apart from the edge of the cutting face, such that during operation, the protrusion(s) may apply stresses to fracture a formation, and the space apart from the edge may allow less stress to accumulate at the edge, thereby increasing durability of the edge.

In some embodiments, a cutting element may include a chamfer formed adjacent to the edge of the cutting element and around the periphery of the cutting face, where the cutting face geometry includes at least one protrusion spaced a distance apart from the chamfer. The distance between a protrusion and a chamfer formed around the periphery of the cutting face may be greater than the radial distance of the chamfer, equal to the radial distance of the chamfer, or less than the radial distance of the chamfer.

Figure 1:
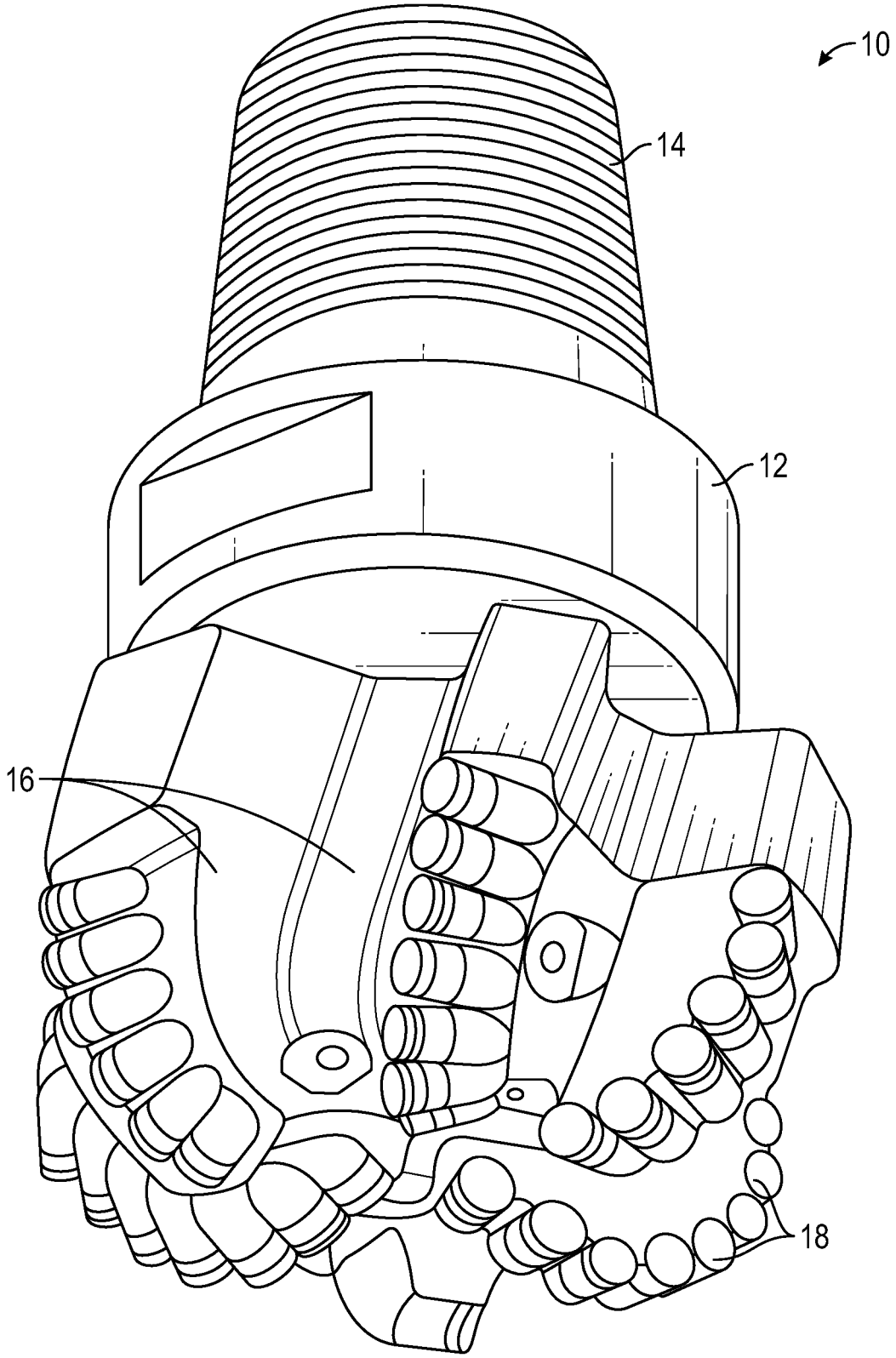
FIG. 1 shows a perspective view of a conventional fixed cutter drill bit.
Figure 2:
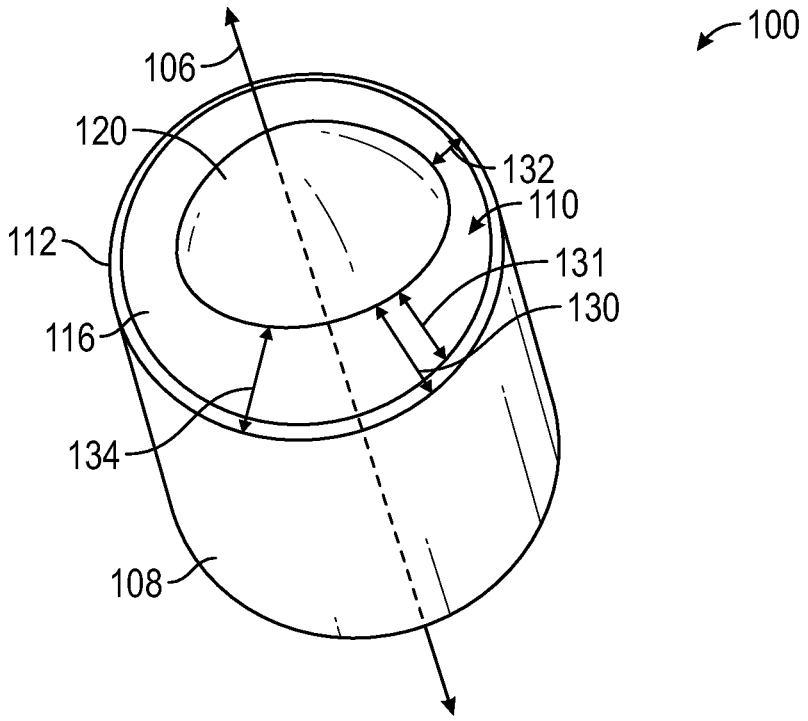
FIG. 2 shows a perspective view of a cutting element according to embodiments of the present disclosure.
Figure 3:
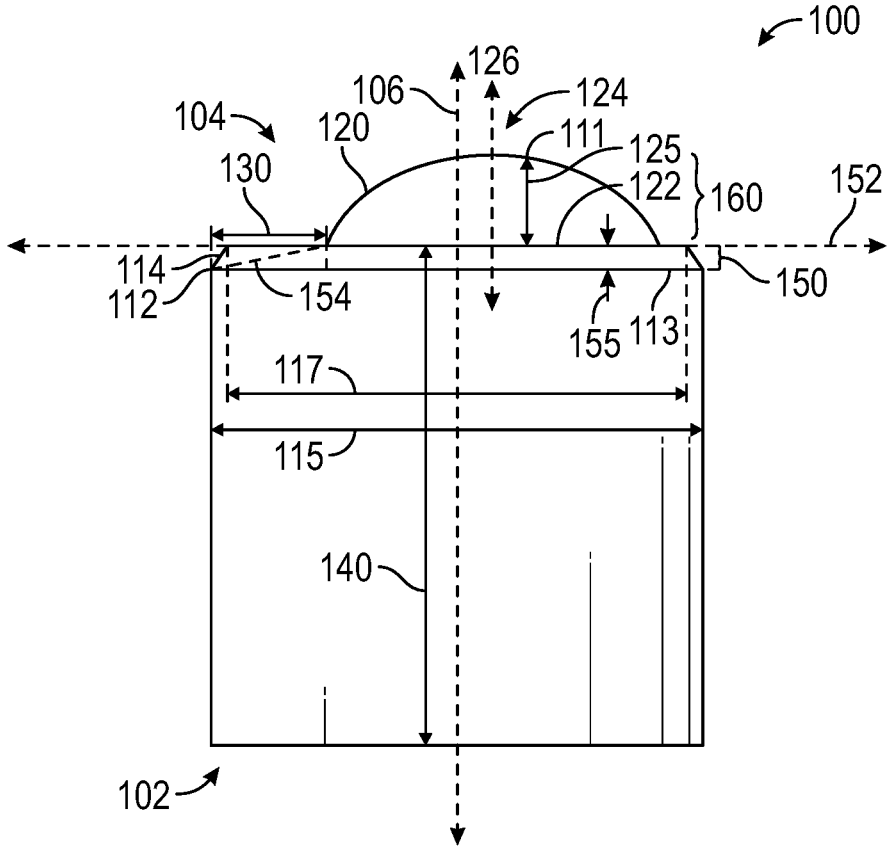
FIG. 3 shows a side view of the cutting element in FIG. 2.

FIGS. 2 and 3 show a perspective view and a side view, respectively, of an example of a cutting element 100 according to embodiments of the present disclosure. The cutting element 100 includes a body having a base 102 and a cutting end 104 at opposite axial ends, an outer side surface 108, and a longitudinal axis 106 extending axially through the center of the cutting element. The body may be formed of a diamond or other ultrahard material table disposed on a substrate, where the ultrahard material table forms the cutting end 104 and the substrate forms the base 102. In some embodiments, the entire body, including the cutting end 104 and the base 102, may be formed of an ultrahard material.

A cutting face 110 is formed at the cutting end 104 of the cutting element and is defined around its periphery by a cutting edge 112, where the intersection between the outer side surface 108 and the cutting face 110 forms the edge 112. In the embodiment shown, a chamfer 114 is formed around the entire periphery of the cutting face 110, where the intersection of the chamfer 114 portion of the cutting face 110 and the outer side surface 108 forms the edge 112. The chamfer 114 slopes radially inward from the edge 112, such that the outer diameter 115 of the chamfer 114 is at a first axial position at the edge 112 of the cutting element, and the inner diameter 117 of the chamfer 114 is radially interior to the edge 112 and at a second axial position relatively farther away from the base 102 of the cutting element than the first axial position. In some embodiments, a cutting face may have a chamfer formed partially around its periphery (less than the entire periphery of the cutting face) or may be without a chamfer around the cutting face periphery.

The cutting face 110 has a geometry that includes a protrusion 120 spaced a radial distance 130 apart from the cutting edge 112 (where the radial distance is measured in a direction from the cutting edge 112 toward the longitudinal axis 106) and a radial distance 131 apart from the inner diameter 117 of the chamfer 114. According to embodiments of the present disclosure, the radial distance 130 between one or more protrusions formed on a cutting face and the edge 112 of the cutting element may vary around the cutting edge 112, for example, when a protrusion 120 is offset from the axial center of the cutting face, when a protrusion 120 is axi-asymmetric about the longitudinal axis 106 of the cutting element, when there are multiple protrusions, and/or when a protrusion has a base shape different than the perimeter of the cutting face 110. For example, as shown in the embodiment of FIGS. 2 and 3, the center axis 126 of the protrusion 120 may be offset from the longitudinal axis 106 of the cutting element, where the radial distance 130 between the protrusion 120 and the cutting edge 112 varies around the edge 112 of the cutting element. In other embodiments, the distance between a protrusion formed on a cutting face and the edge of the cutting element may be uniform around the cutting edge.

The radial distance 130 may range, for example, from 0 percent, at least 1 percent, at least 2 percent, at least 5 percent, or at least 10 percent of the cutting face diameter 115 to less than 20 percent, less than 30 percent, or less than 45 percent of the cutting face diameter 115 when the protrusion 120 is axi-symmetric, and may range, for example, from 0 percent, at least 1 percent, at least 2 percent, at least 5 percent, or at least 10 percent of the cutting face diameter 115 to less than 60 percent, less than 70 percent, less than 80 percent or less than 90 percent of the cutting face diameter 115 when the protrusion 120 is axi-asymmetric. For example, in the embodiment shown in FIGS. 2 and 3, the distance 130 may be between 2 and 10 percent of the cutting face diameter 115 at the point 132 where the protrusion 120 is closest to the cutting edge, and the distance 130 may be between 20 and 40 percent of the cutting face diameter from the point 134 around the cutting edge 112 where the protrusion 120 is farthest away from the cutting edge 112.

Further, the radial distance 131 between a protrusion 120 and an inner diameter of a chamfer 114 may range, for example, from 0 percent, at least 1 percent, at least 2 percent, at least 5 percent, or at least 10 percent of the cutting face diameter 115 to less than 20 percent, less than 30 percent, or less than 45 percent of the cutting face diameter 115 when the protrusion 120 is axi-symmetric, and may range, for example, from 0 percent, at least 1 percent, at least 2 percent, at least 5 percent, or at least 10 percent of the cutting face diameter 115 to less than 60 percent, less than 70 percent, less than 80 percent or less than 90 percent of the cutting face diameter 115 when the protrusion 120 is axi-asymmetric.

Geometry of a cutting face according to embodiments of the present disclosure may generally be described under two categories: a protruding portion 160 and a lower portion 150, where the protruding portion 160 may include the one or more protrusions formed on the cutting face 110, and the lower portion 150 may include the portion of the cutting face 110 within the distance (e.g., radial distance 130) between the one or more protrusions 120 and the cutting edge or outer perimeter of the cutting face. In embodiments having a chamfer 114 formed around at least a portion of the cutting face periphery, the lower portion 150 of the cutting face 110 may include the chamfer 114.

A cutting element height 140 is measured axially between the base 102 and the cutting face 110 of the cutting element 100. The height 140 around the edge 112 and within a lower portion 150 of the cutting face may vary by less than 10 percent, less than 5 percent, or less than 2 percent. The protruding portion 160 of the cutting face includes a single protrusion 120 having an axial height 125 measured between the protrusion base 122 and the cutting face surface 111 along the protrusion 120. The lower portion 150 may have an axial height 155 measured between the lowest axial point 113 in the lower portion 150 (which in the embodiment shown, is around the edge 112 of the cutting element 100 where the cutting face 110 meets the outer side surface 108 of the cutting element 100) and the base 122 of the protrusion 120. According to embodiments of the present disclosure, the lower portion 150 may have an axial height 155 that is less than 30 percent, less than 20 percent or less than 10 percent of the greatest axial height 125 of the protrusion 120, where the greatest axial height of the protrusion is measured between the base 122 of the protrusion 120 and the highest point (e.g., apex 124) of the protrusion 120.

A lower portion 150 may be distinguished from a protruding portion 160, for example, by the difference in axial heights within each region. In embodiments where the cutting element base 102 is a substantially planar surface extending along a plane perpendicular to the cutting element's longitudinal axis 106, the lower portion 150 may be distinguished from the protruding portion 160 by the difference in the cutting element height within each region, as measured from the base 102 of the cutting element to its cutting face 110. For example, a height 140 measured between the base 102 and cutting face 110 of a cutting element in a lower portion 150 may vary by less than 10 percent, less than 5 percent, or less than 2 percent, while the height 125 in a protruding portion 160 may vary by at least 15 percent, at least 20 percent, or at least 25 percent. In some embodiments, a lower portion 150 may be distinguished as a region around the edge 112 of a cutting element 100 that has a variance in axial height as measured from the axial lowest point 113 in the lower portion 150 to the highest axial point 122 in the lower portion 150 that is less than 10 percent of a greatest axial height of the protrusion(s) on the cutting face, where the greatest axial height of protrusion(s) on a cutting face is measured axially between a protrusion base 122 and a highest axial point 124 of the protrusion(s).

In the embodiment shown in FIGS. 2 and 3, the protruding portion 160 includes a single protrusion 120 having a dome shape. However, possible protrusion geometry may also include other three-dimensional shapes having a rounded top or apex. For example, in some embodiments, a protrusion may be a pyramid shape having multiple planar lateral faces extending from a polygonal base shape to a rounded apex. In some embodiments, a protrusion may have a polygonal base shape with multiple curved or otherwise nonplanar lateral faces extending from the base to a rounded apex. Further possible protrusion geometries may include three-dimensional shapes having an angled top or apex. For example, a protrusion may have a truncated pyramid shape, where the top of the truncated pyramid may be a substantially planar surface.

The lower portion 150 includes a chamfer 114 formed around the edge 112 of the cutting element, where the chamfer 114 may provide the only height variance within the lower portion 150. In such embodiments, the axial height 155 of the chamfer, and thus the axial height 155 of the lower portion, may be less than 10 percent or less than 5 percent, for example, of the greatest axial height 125 of the protrusion 120.

The lower portion 150 further includes a planar surface 116 extending along a plane 152 perpendicular to the longitudinal axis 106 of the cutting element. The planar surface 116 extends circumferentially around the entire base 122 of the protrusion 120 and radially from the base 122 of the protrusion 120 to the chamfer 114. In other embodiments, a planar surface along a plane 152 perpendicular to the longitudinal axis 106 may extend less than the entire perimeter of a protrusion 120. Further, in embodiments where the cutting element does not have a chamfer formed around at least a portion of the cutting edge, a planar surface along a plane perpendicular to the longitudinal axis may extend from at least one protrusion fully to the cutting edge.

As described above, a lower portion 150 of a cutting face has a limited axial height, as measured from the lowest point 113 of the lower portion 150 to the highest point 122 of the lower portion 150 (which in this embodiment but not all embodiments, may be the base 122 of a protrusion 120). Accordingly, cutting elements of the present disclosure may have a lower portion 150 defined around the cutting edge 112 as a portion of the cutting face 110 extending a radial distance 130 from the cutting edge 112 toward the longitudinal axis 106 with a limited axial height 155.

Figure 5:
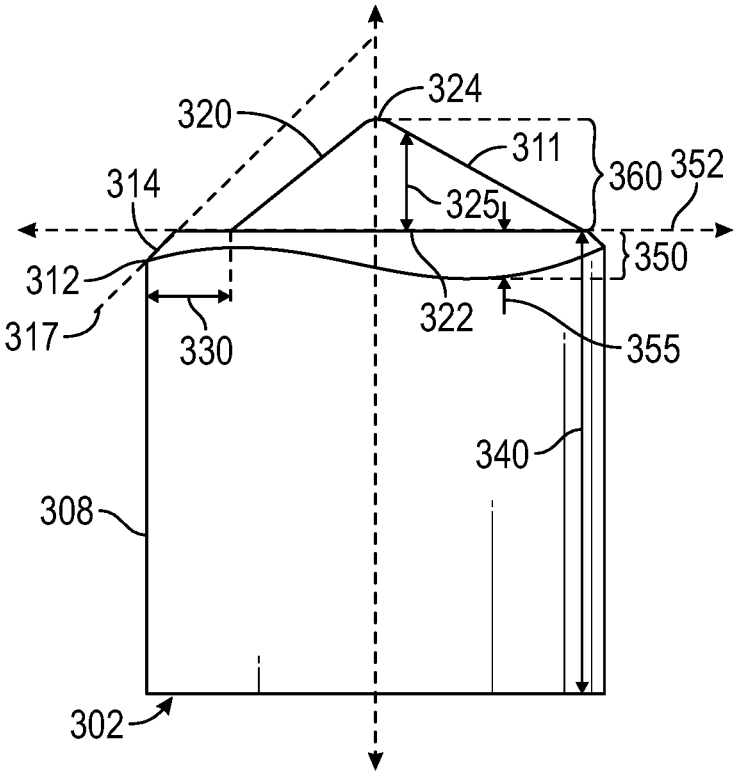
FIG. 5 shows a side view of the cutting element in FIG. 4.

A lower portion 150 of a cutting face 110 may have one or more planar surfaces 116 and/or one or more curved surfaces such as a concave surface or a convex surface, where individually and collectively, the one or more surfaces have a limited axial height 155. For example, according to embodiments of the present disclosure, a cutting face geometry may include a lower portion 150 having at least one planar surface 116 extending along a plane 152 perpendicular to a longitudinal axis 106 of the cutting element. In some embodiments, a cutting face geometry may include a lower portion 150 having at least one planar surface 116 extending along a plane 152 perpendicular to a longitudinal axis 106 of the cutting element and at least one sloped surface (such as shown in FIG. 5 and discussed more below). For example, one or more sloped surfaces in a lower portion of a cutting face may extend downwardly from a planar surface toward the cutting edge.

According to embodiments of the present disclosure, a lower portion 150 may have a planar portion surrounding at least part of the base 122 of a protrusion 120. A planar portion may be a surface 116 extending along a plane 152 perpendicular to a longitudinal axis 106 of the cutting element 100, or may be a sloped surface (shown by phantom line 154) having a shallow slope from a plane 152 perpendicular to the longitudinal axis 106, such that the sloped surface 154 remains within a limited axial height 155.

FIGS. 4-9 show examples of cutting elements according to embodiments of the present disclosure having a cutting face with a lower portion geometry including at least one planar surface and at least one sloped surface.

Figure 4:
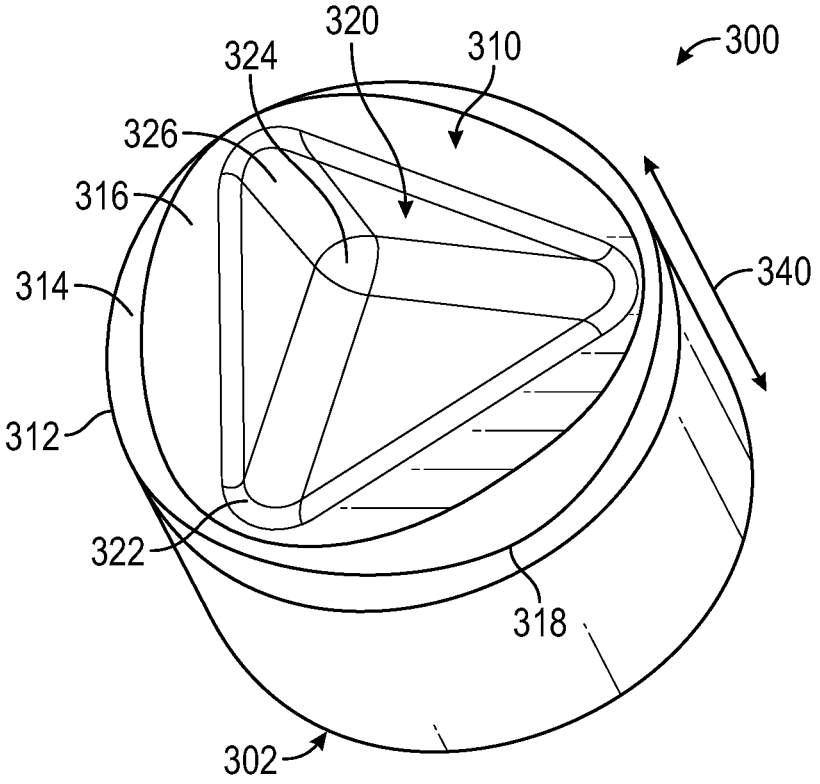
FIG. 4 shows a perspective view of a cutting element according to embodiments of the present disclosure.

Referring to FIGS. 4 and 5, a perspective view and a side view, respectively, of a cutting element 300 according to embodiments of the present disclosure are shown. The cutting element 300 includes a base 302 and a cutting face 310 at opposite axial ends of the cutting element and a longitudinal axis 306 extending axially through the cutting element 300, where the cutting element height 340 is measured axially from the base 302 to the cutting face 310. The cutting face 310 includes a protruding portion 360 formed of a single protrusion 320 and a lower portion 350 formed of a planar portion 316 and multiple sloped surfaces 314.

In the embodiment shown, the planar portion includes a planar surface 316 extending entirely around the protrusion 320 and along a plane 352 perpendicular to the cutting element longitudinal axis 306 and in a radial direction. The sloped surfaces 314 extend in an axial and radial direction away from the planar surface 316 toward the cutting edge 312 of the cutting element, at a slope 317 with respect to the longitudinal axis 306. The edge 312 is formed at the intersection between the sloped surfaces 314 and the outer side surface 308 of the cutting element 300. As shown, the lower portion 350 includes a number of sloped surfaces 314 corresponding to the number of sides of the protrusion base 322 (in this case 3); however, other embodiments may include more or less sloped surfaces. The sloped surfaces 314 intersect with the cutting edge 312 and with the planar surface 316 at angled transitions. In other embodiments, transitions between adjacent surfaces may be curved or chamfered. The planar surface 316 and sloped surfaces 314 are positioned radially between the protrusion 320 and the edge 312 of the cutting element 300 such that the protrusion 320 is spaced apart from the edge 312 by a radial distance 330.

The axial height 355 of the lower portion 350 is measured axially between the lowest point(s) 318 of the lower portion (which in the embodiment shown is at the thickest part of the sloped surfaces 314) and the highest point of the lower portion (which in the embodiment shown, is along the planar surface 316, and is at the same axial height as the base 322 of the protrusion 320). The axial height 325 of the protruding portion 360 is measured axially between the base 322 of the protrusion 320 and the cutting face surface 311. The greatest axial height 325 of the protruding portion 360 is measured axially between the base 322 of the protrusion 320 and the highest part of the protrusion 320, which in the embodiment shown is at the protrusion apex 324. The axial height 355 of the lower portion 350 of the cutting face may be limited to, for example, less than 15 percent of the greatest axial height 325 of the protruding portion 360 of the cutting face 310.

Further, the protrusion 320 shown in FIGS. 4 and 5 has the shape of a triangular pyramid with rounded edges 326 and a rounded apex 324. However, in other embodiments, a protrusion may have a different pyramid-type shape, including a square pyramid or other polygonal pyramid, a pyramid having angular edges between its lateral faces, or a truncated pyramid having angular and/or rounded edges. In some embodiments, a protrusion may be a linearly extending ridge, a dome, or other regular or irregular three-dimensional shape.

Figure 6:
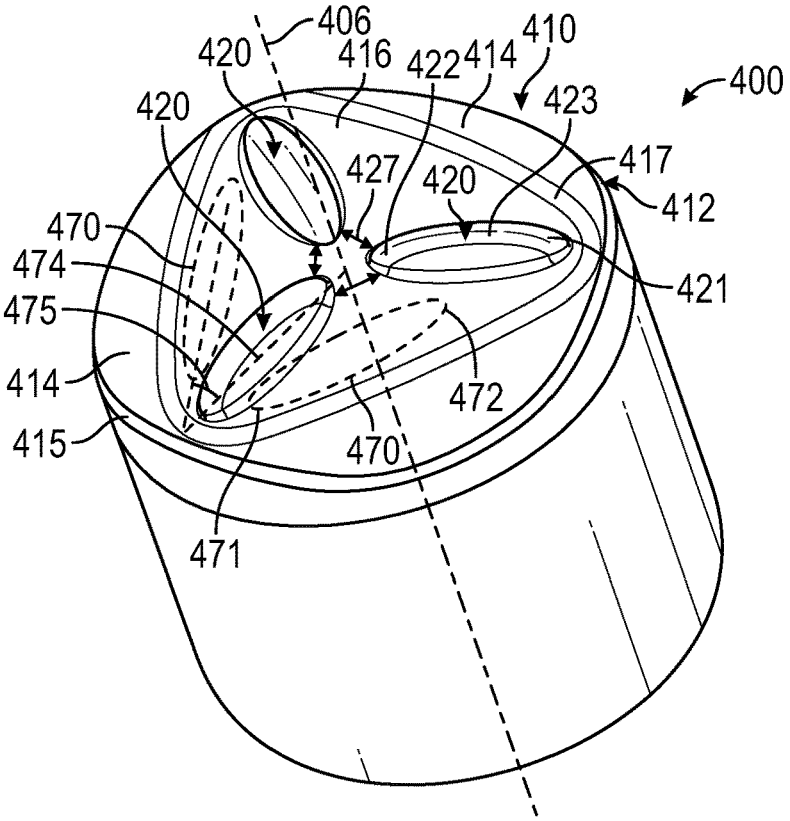
FIG. 6 shows a perspective view of a cutting element according to embodiments of the present disclosure.
Figure 7:
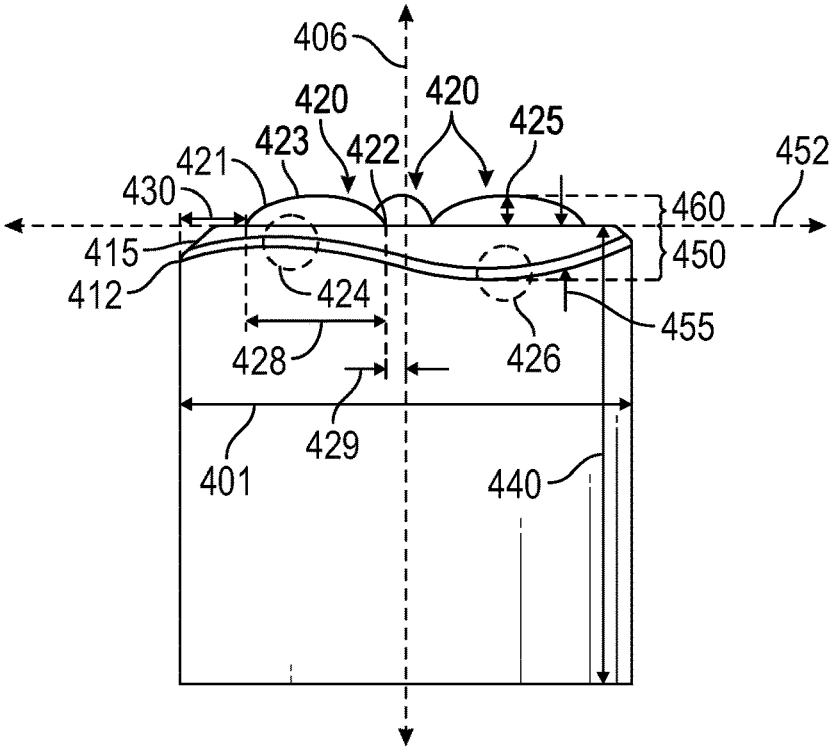
FIG. 7 shows a side view of the cutting element in FIG. 6.

In some embodiments, a protruding portion may have more than one protrusion. For example, FIGS. 6 and 7 show a perspective view and a side view, respectively, of a cutting element 400 according to embodiments of the present disclosure having multiple protrusions 420, where each protrusion 420 is spaced apart from the cutting edge 412 of the cutting element by a radial distance 430 and spaced apart from each other by distance 427. In the embodiment shown, the cutting face 410 of the cutting element has a protruding portion 460 that includes three spaced apart protrusions 420. The protrusions 420 may be spaced apart such that the cutting face at the longitudinal axis 406 and between the protrusions 420 is planar and perpendicular to the longitudinal axis 406. However, other embodiments may include more than three spaced apart protrusions, two spaced apart protrusions, or a single protrusion.

In some embodiments, a protrusion 420 may have a ridge shape extending a length along the cutting face. One or more ridges may be arranged on a cutting face to extend a length 428 in the radial dimension of the cutting face 410, along a portion of the cutting face diameter 401. For example, a cutting face may include a single ridge protrusion extending a partial diameter of the cutting face, from a first linear end positioned a distance from the cutting edge, through the longitudinal axis of the cutting element, and to a second linear end positioned a distance from the opposite cutting edge. In another example, such as shown in FIGS. 6 and 7, a ridge protrusion 420 may extend a partial diameter (length 428) of the cutting face 410, from a first linear end 421 positioned a radial distance 430 from the cutting edge 412 to a second linear end 422 positioned near the longitudinal axis 406. A ridge protrusion may vary in height. For example, the linear ends 421, 422 of a ridge 420 may be relatively lower than a central portion of the ridge, such that the central portion may be an apex 423 of the ridge 420. Further, a ridge protrusion may have a top side that may be angled, rounded, or flat.

In the embodiment shown, each protrusion 420 has a ridge shape that extends linearly from near the longitudinal axis 406 in a radial direction toward the cutting edge 412. The top side of each ridge protrusion 420 is rounded along both its length and width. In the lengthwise direction (along length 428), each protrusion 420 has a first linear end 421 positioned a radial distance 430 apart from the cutting edge 412, an apex 423, and a second linear end 423 positioned a distance 429 apart from the longitudinal axis 406, where the axial height 425 of the ridge 420 along the length 428 decreases from the apex 423 toward the linear ends 421, 422. According to embodiments of the present disclosure, a ridge-shaped protrusion may have different top side geometry, including, for example, a planar top side at a substantially uniform ridge height, a sloped top side, a rounded top side, or an angled top side.

In embodiments having at least one ridge shaped protrusion, the ridge may extend linearly along a radial direction, and may either extend radially from a distance apart from the cutting edge and through the central longitudinal axis (e.g., a radial distance greater than the radius of the cutting face), or as shown in FIGS. 6 and 7, may extend radially from a radial distance 430 apart from the cutting edge 412 to a distance 429 apart from the central longitudinal axis 406 (i.e., a radial distance less than the radius of the cutting face).

In some embodiments, a ridge shaped protrusion may extend linearly along a non-radial direction. For example, a ridge shaped protrusion (shown by phantom lines 470) may extend linearly at an angle 475 from a radial direction 474, e.g., from a first linear end 471 positioned a radial distance 430 apart from the cutting edge 412 to a second linear end 472 positioned a radial distance 430 apart from the cutting edge 412, where the ridge 470 does not extend through the longitudinal axis 406. In some embodiments having a ridge extend linearly along a non-radial direction, the ridge may extend a partial chord of the cutting face.

Further, the protrusions 420 shown in FIGS. 6 and 7 are arranged axisymmetric around the longitudinal axis 406 of the cutting element 400. With such a configuration, the cutting element 400 may have three identical potential working portions of the cutting edge 412 (i.e., the portion of the cutting edge anticipated to contact a working surface during operation) including the portions of the cutting edge 412 near (but not contacting) linear ends 421 of the protrusion ridges 420. Advantageously, this type of configuration may allow, for example, for the cutting element 400 to be rotated and reused within a cutting tool if one of the working portions of the cutting edge 412 wears from prior use. According to embodiments of the present disclosure, a cutting face may have other configurations using multiple protrusions spaced apart from the cutting edge, including, for example, multiple protrusions having different shapes, using more or less than three protrusions, and/or spacing multiple protrusions axisymmetrically or axi-asymmetrically around the longitudinal axis.

Referring still to FIGS. 6 and 7, the cutting face geometry also has a lower portion 450 axially separating the protruding portion 460 from the cutting edge 412 of the cutting element 400, where the lower portion 450 includes a planar surface 416 extending along a plane 452 perpendicular to the longitudinal axis 406 of the cutting element, multiple sloped surfaces 414, and a chamfer 415 formed along the cutting edge 412. The sloped surfaces 414 extend from a radiused or curved transition 417 from the planar surface 416 at a slope to the chamfer 415 formed around the cutting edge 412, such that the cutting element height 440 at the transition 417 with the planar surface 416 is greater than the cutting element height 440 at the transition to the chamfer 415. Further, the cutting element height 440 along the sloped surfaces 414 decrease around the cutting edge 412 from a region 424 along the cutting edge closest to the first linear ends 421 of the protrusions 420 to a lowest region 426 along the cutting edge 412.

The variance in height along the sloped surfaces 414 provide regions 424 around the cutting edge 412 closest to the protrusions 420 that have smaller variations in height than regions 426 around the cutting edge 412 farthest from the protrusions 420. For example, the axial height of the lower portion 450 of the cutting face within the radial distance 430 between a region 424 along the cutting edge 412 closest to the protrusions 420 and the protrusions 420 may be less than 50 percent, less than 20 percent, less than 10 percent or less than 5 percent of the axial height 440 of the remaining lower portion 450 of the cutting face. In some embodiments, regions 424 around the cutting edge closest to the protrusions 420 may have an axial height 440 that is less than 10 percent, less than 5 percent, less than 2 percent, or less than 1 percent of the greatest axial height 425 of the protrusion(s).

Figure 8:
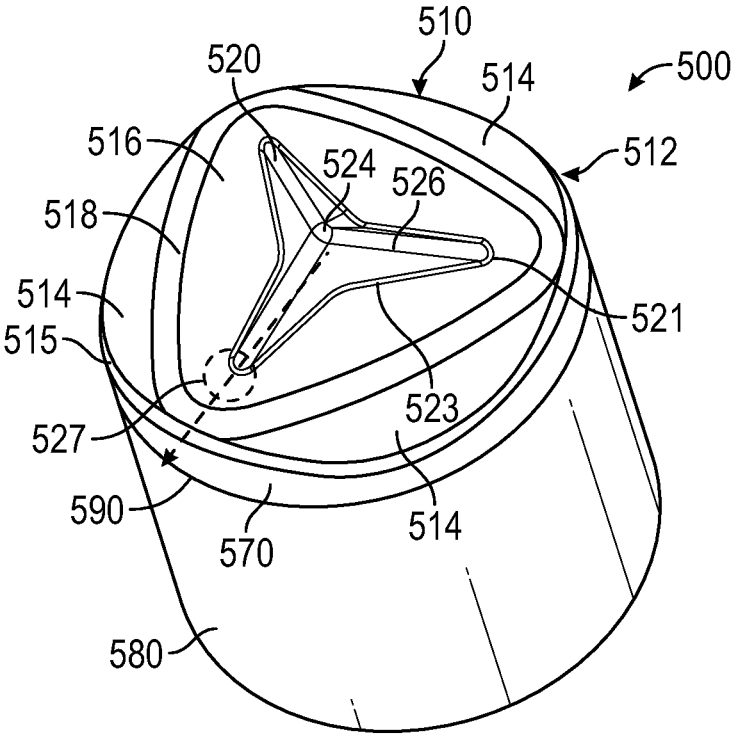
FIG. 8 shows a perspective view of a cutting element according to embodiments of the present disclosure.
Figure 9:
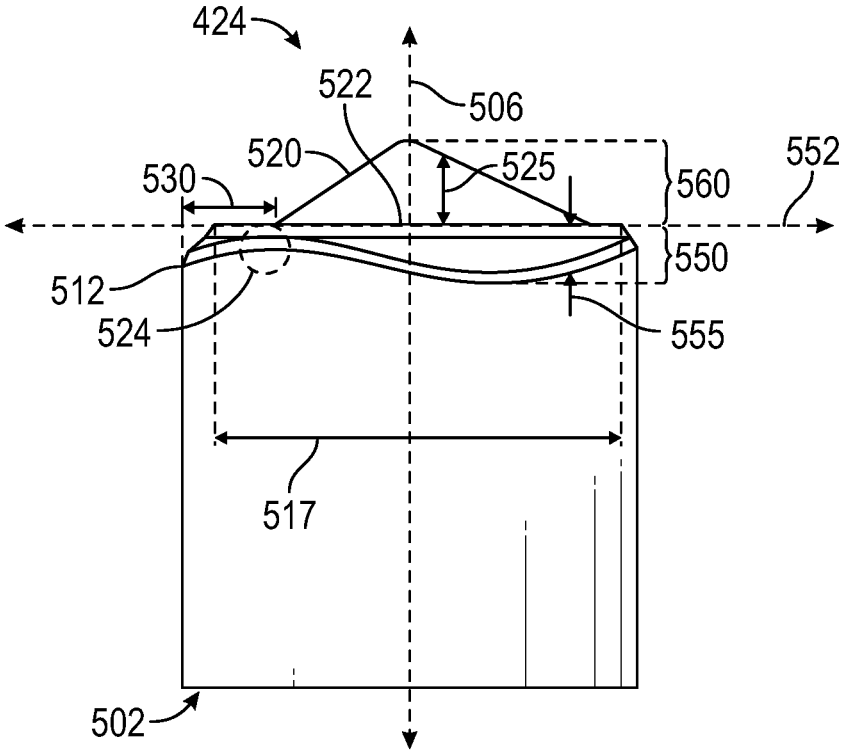
FIG. 9 shows a side view of the cutting element in FIG. 8.

Referring now to FIGS. 8 and 9, a perspective view and a side view, respectively, of another example of a cutting element 500 according to embodiments of the present disclosure is shown. The cutting element 500 has a cutting face 510 formed at an opposite axial end from the cutting element base, where the cutting face 510 includes a protruding portion 560 and a lower portion 550. The protruding portion 560 is formed of a single protrusion 520, the geometry of which includes three linear ridges 526 extending from lower linear ends 521 to higher linear ends meeting at an apex 524.

In some embodiments, the cutting face geometry may include multiple ridges 526 joined together at an apex 524. In some embodiments, the cutting face geometry may include multiple protrusions that are spaced apart from each other (e.g., as shown in FIGS. 6 and 7). Further, according to embodiments disclosed herein, one or more protrusions 520 formed on a cutting face 510 may be axisymmetric (e.g., as shown in FIGS. 8 and 9, where the protrusions 520 extend symmetrically around the longitudinal axis 506 of the cutting element 500) or axi-asymmetric about a longitudinal axis 506 of the cutting element.

The lower portion 550 of the cutting face 510 includes a planar surface 516 extending along a plane 552 perpendicular to the longitudinal axis 506 of the cutting element 500. Further, the planar surface 516 surrounds the entire base 522 of the protrusion 520, where the base 522 of the protrusion 520 transitions to the planar surface 516 at a curved transition 523. The planar surface 516 further creates a space between the protrusion 520 and a chamfer 518 formed around the perimeter of the planar surface 516. Three sloped surfaces 514 extend in a direction axially and radially away from a central region (including the planar surface 516 and the chamfer 518 around the planar surface 516) of the cutting face 510 toward the cutting edge 512. The sloped surfaces 514 are bordered and surrounded entirely by two chamfers: a chamfer 515 interior to and formed around the cutting edge 512 and the chamfer 518 formed around the perimeter of the planar surface 516.

The two chamfers 515 and 518 may intersect with each other along axially highest regions 524 of the edge 512, forming dual chamfer cutting tips 527. The axially highest regions 524 of the edge of the cutting element 500 and/or a dual chamfer cutting tip 527 may be radially aligned (i.e., along a shared radial plane, an example of which is shown by phantom line 528) with a linear ridge 526 of a protrusion 520. A dual chamfer cutting tip formed by two intersecting chamfers proximate an edge of a cutting element may be formed on other embodiments of the present disclosure, as well. For example, a dual chamfer cutting tip may be formed on the embodiment shown in FIGS. 6 and 7 by modifying the cutting element design to have a second chamfer formed around the planar surface 416 and intersecting with chamfer 415, or a dual chamfer cutting tip may be formed on the embodiment shown in FIGS. 4 and 5 by modifying the cutting element design to have a first chamfer formed around and adjacent to the edge 312 of the cutting element and a second chamfer formed around the planar surface 316.

The sloped surfaces 514 and the chamfers 515, 518 may each have a slope that maintains the surfaces of the lower portion 550 of the cutting face within a limited axial height 555, which may be, for example, less than 50 percent, less than 20 percent, less than 10 percent, or less than 5 percent of the greatest axial height 525 of the protrusion 520. The slope of the chamfers with respect to the longitudinal axis 506 of the cutting element may be greater than the slope of the slope surfaces 514, and the slope of the chamfers with respect to the longitudinal axis 506 may be greater than a protrusion slope of the protrusion 520 from an axially highest point of the protrusion to a base of the protrusion.

The protrusion 520 may be spaced apart from both the nearest chamfer (chamfer 518) and the edge 512 of the cutting element. As shown, the protrusion 520 is spaced a radial distance 530 from the edge 512 of the cutting element and spaced apart a smaller radial distance from the inner diameter 517 of the chamfer 518.

Figure 10:
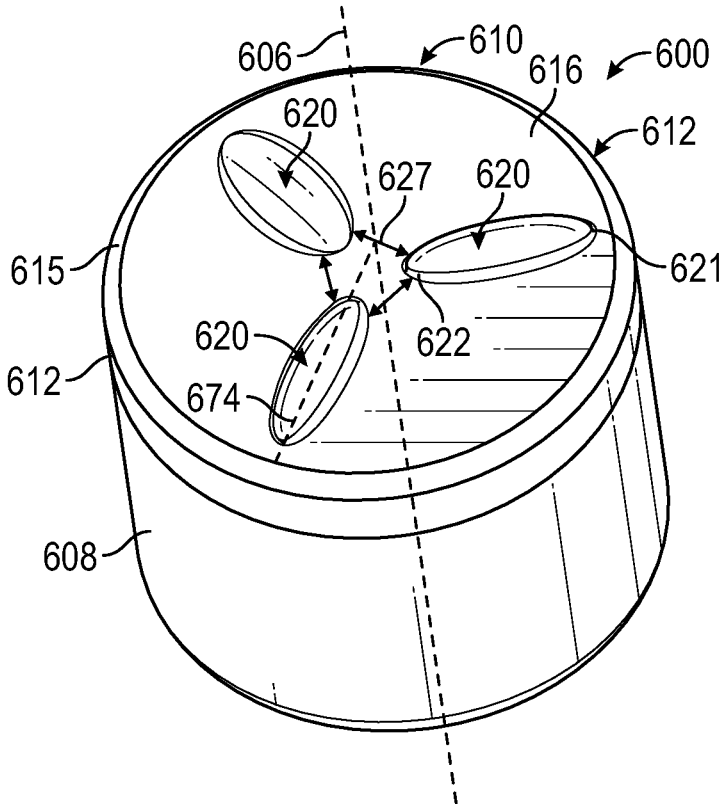
FIG. 10 shows a perspective view of a cutting element according to embodiments of the present disclosure.
Figure 11:
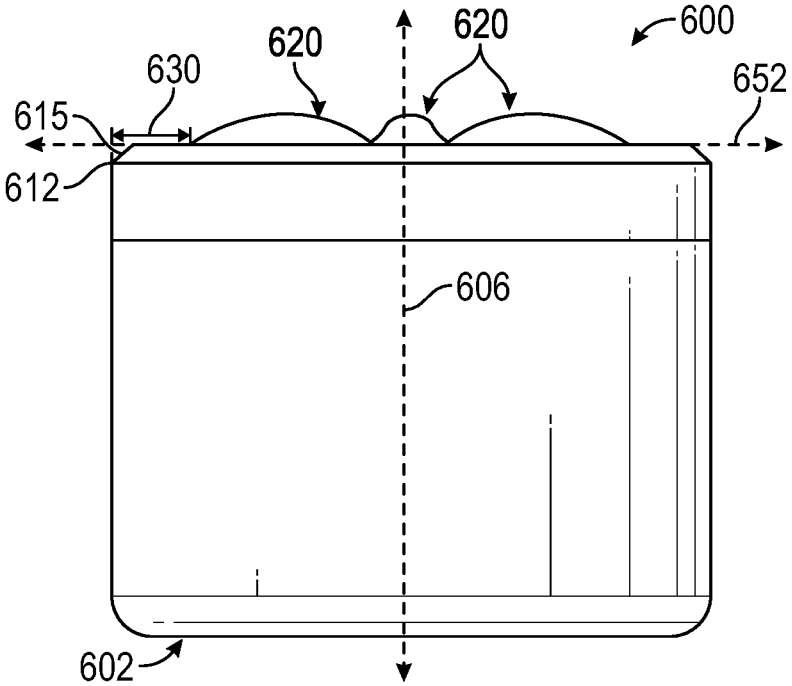
FIG. 11 shows a side view of the cutting element in FIG. 10.

FIGS. 10 and 11 show a perspective view and side view, respectively, of another example of a cutting element 600 according to embodiments of the present disclosure. The cutting element 600 includes a cutting face 610 and a base at opposite axial ends of the cutting element 600, an outer side surface 608, and an edge 612 formed by the intersection of the cutting face 610 with the side surface 608. The cutting face 610 geometry includes three spaced apart protrusions 620 positioned a radial distance 630 from the edge 612 of the cutting element 600, a planar surface 616 that entirely surrounds the protrusions 620, and a chamfer 615 formed adjacent to and extending around the edge 612.

Each of the protrusions 620 are ridges extending linearly in a radial direction 674 from a first linear end 621 (spaced a radial distance 630 from the edge 612 of the cutting element 600) to a second linear end 622 near the longitudinal axis 606 of the cutting element 600. The second linear ends 622 of the protrusions 620 are spaced apart from the longitudinal axis 606 and from each other by distance 627. The planar surface 616 extends along a plane 652 perpendicular to the longitudinal axis 606 and entirely surrounds each of the protrusions 620. The chamfer 615 slopes between the planar surface 616 and the edge 612 of the cutting element 600, extending in the axial dimension from the planar surface 616 in a direction toward the base 602 of the cutting element 600 and extending in the radial dimension from the planar surface 616 in a radial outward direction.

Figure 12:
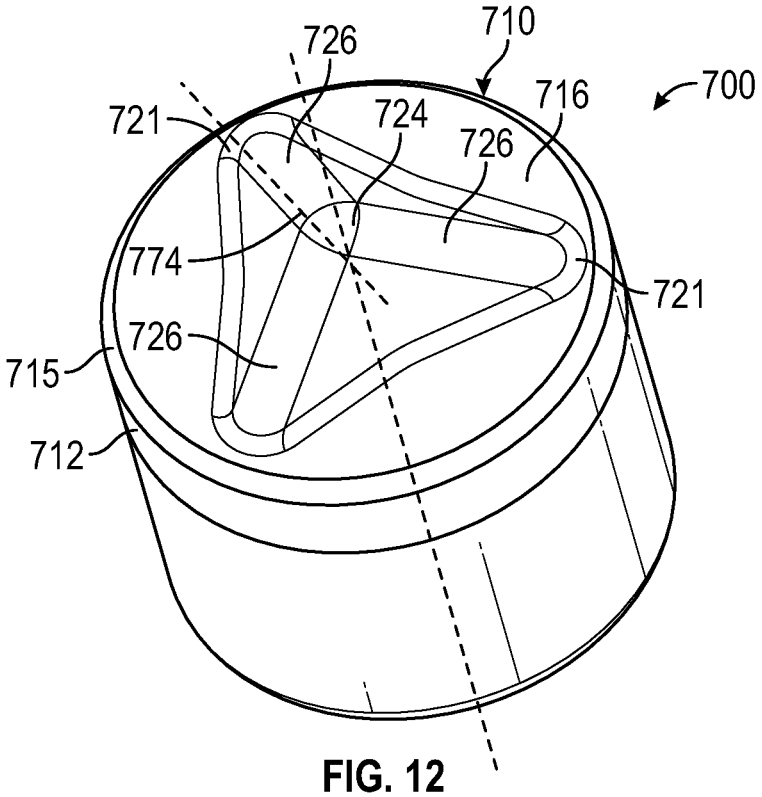
FIG. 12 shows a perspective view of a cutting element according to embodiments of the present disclosure.
Figure 13:
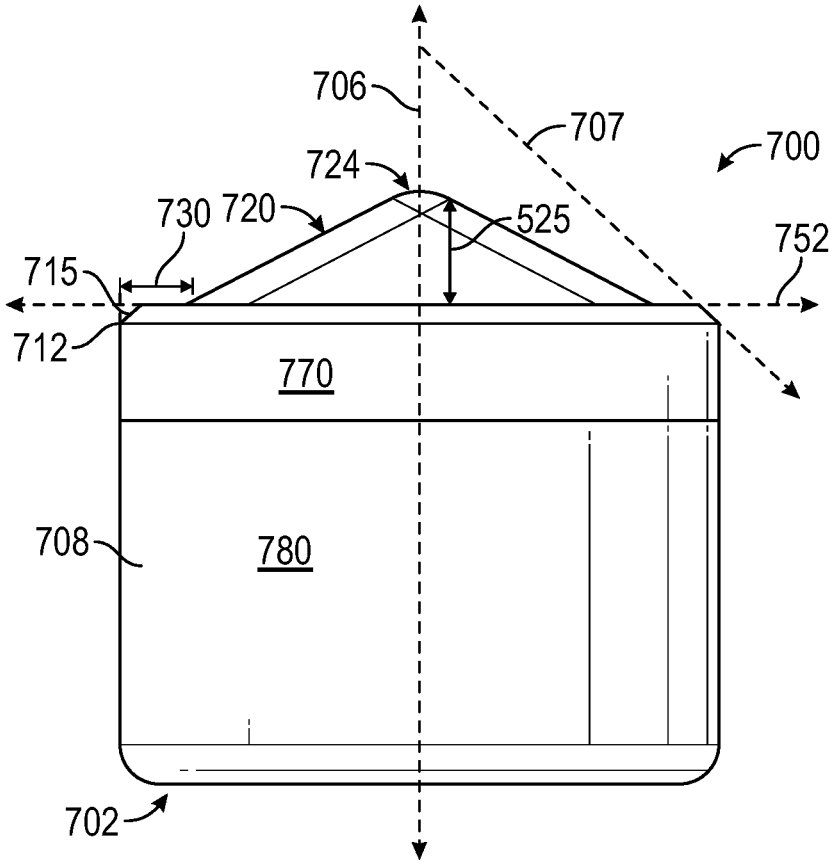
FIG. 13 shows a side view of the cutting element in FIG. 12.

FIGS. 12 and 13 show a perspective view and a side view, respectively, of another example of a cutting element 700 according to embodiments of the present disclosure. The cutting element 700 has a cutting face 710 and base 702 at opposite axial ends of the cutting element 700, a longitudinal axis 706 extending axially through the cutting element 700, an outer side surface 708, and an edge 712 formed at the intersection of the outer side surface 708 and the cutting face 710.

The cutting face 710 geometry includes a protrusion 720 interior to and spaced a radial distance 730 apart from the edge 712 of the cutting element. The cutting face 710 geometry further includes a planar surface 716 entirely surrounding the protrusion 720, where the planar surface 716 extends along a plane 752 perpendicular to the longitudinal axis 706 from the border of the protrusion 720 to a chamfer 715. The chamfer 715 is formed between the planar surface 716 and the edge 712 of the cutting element 700 and extends around the entire edge 712 of the cutting element. Further, the chamfer 715 has a slope 707 with respect to the longitudinal axis 706, extending axially from the planar surface 716 in a direction toward the base 702 of the cutting element and radially outward from the planar surface 716.

The protrusion 720 has a pyramid-like geometry of three linear ridges 726 extending in a radial direction 774 from a first linear end 721 and joining together at an apex 724 at the longitudinal axis 706, where the axial height 725 of the protrusion 720 gradually increases from the first linear ends 721 to the apex 724. The first linear ends 721 may be equally spaced apart in circumferential direction, such as shown in FIG. 12, or may be unequally circumferentially spaced apart (e.g., such as a in the circumferential spacing between the tips of a "Y"). Further, the first linear ends 721 are each spaced a radial distance 730 apart from the edge 712 of the cutting element 700. The first linear ends 721 may be proximate to but spaced apart from the chamfer 715, such as shown in the embodiment of FIGS. 12 and 13, or an end of a protrusion may be in contact with a chamfer.

According to embodiments of the present disclosure, a cutting element may include a diamond table disposed at a cutting end of its body, where the cutting face is formed on the diamond table at the cutting end. Cutting face geometry on a diamond table may include any cutting face geometry described herein, including, for example, a planar portion entirely surrounding at least one protrusion raised from the planar portion.

The embodiments of FIGS. 4-13 show examples of cutting elements having a diamond table disposed on a substrate, where the cutting face is formed on the diamond table, and the substrate forms the base. For example, as seen in FIG. 8, a diamond table 570 is disposed on a substrate 580 at an interface 590, where the cutting face 510 is formed at the cutting end of the diamond table 570, and the base is formed on the substrate 580 at an opposite axial end. In FIG. 13, a diamond table 770 and substrate 780 are also denoted, where the diamond table 770 forms the cutting face 710, and the substrate 780 forms the base 702 of the cutting element 700.

A diamond table may be disposed on a substrate, for example, by forming the diamond table on the substrate, infiltrating, brazing, or other means of attachment. For example, a diamond table may be formed on a substrate by positioning diamond powder on a pre-formed substrate or on substrate material and subjecting the diamond powder to high pressure high temperature conditions sufficient for diamond-to-diamond bonding to occur, resulting in a polycrystalline diamond table attached to a substrate. In another example, a diamond table may be brazed to a substrate. Other methods of attaching a diamond table to a substrate may be used to form cutting elements according to embodiments disclosed herein.

A diamond table may be formed of, for example, thermally stable polycrystalline diamond, polycrystalline diamond, diamond composite material, and combinations thereof. Further, cutting elements of the present disclosure may utilize different types of ultrahard material to form the cutting end of the cutting element, either instead of or in addition to diamond. For example, diamond-cermet composite material, cubic boron nitride, or other ultrahard material composites may be used to form a cutting end of a cutting element according to embodiments of the present disclosure.

Substrate material may include, for example, a metal carbide and a metal binder which has been sintered. Suitably, the metal of the metal carbide may be selected from chromium, molybdenum, niobium, tantalum, titanium, tungsten and vanadium and alloys and mixtures thereof. For example, sintered tungsten carbide may be formed by sintering a stoichiometric mixture of tungsten carbide and a metal binder.

The geometry of the cutting face may be formed, for example, by pressing ultrahard material (e.g., diamond powder) into a mold having the negative shape of the cutting face geometry and subjecting the material to high pressure high temperatures and/or infiltrating the ultrahard material (where conditions may depend on the ultrahard material) to form an ultrahard table having a cutting face with geometry described herein. In some embodiments, the geometry of the cutting face may be formed by cutting away material from an ultrahard body (e.g., by laser cutting) to form at least one protrusion spaced a distance apart from an edge of the ultrahard material body.

In some embodiments, after a cutting face geometry is formed on an ultrahard material body, the ultrahard material body may be treated to change the composition of at least a portion of the cutting face. For example, a polycrystalline diamond table having a cutting face geometry according to embodiments of the present disclosure may be leached along at least a portion of the cutting face to form thermally stable polycrystalline diamond portions of the cutting face.

According to embodiments of the present disclosure, the distance between one or more protrusions on a cutting face and the cutting edge may correspond with a potential depth of cut of the cutting element when cutting. For example, a tool designer may anticipate a cutting element's position on a cutting tool, including, for example, back rake of the cutting element, side rake of the cutting element, and exposure height of the cutting element from the tool surface, to name a few. Based on the cutting element's position on the cutting tool and other anticipated operational factors, such as the type of formation being drilled, weight on bit, tool rotational speed, and/or others, the tool designer may further anticipate the cutting element's depth of cut (depth into the formation that the cutting element penetrates). From the design assumptions made in determining a cutting element's potential depth of cut, the tool designer may design the cutting face geometry to include at least one protrusion spaced apart from a working portion of the cutting edge by a lower portion, such that during operation, only a lower portion of the cutting face may contact a working surface (e.g., an earthen formation) at an initial depth of cut, and both the lower portion and part of the protrusion may contact the working surface at a depth of cut deeper than the initial depth of cut.

Figure 14:
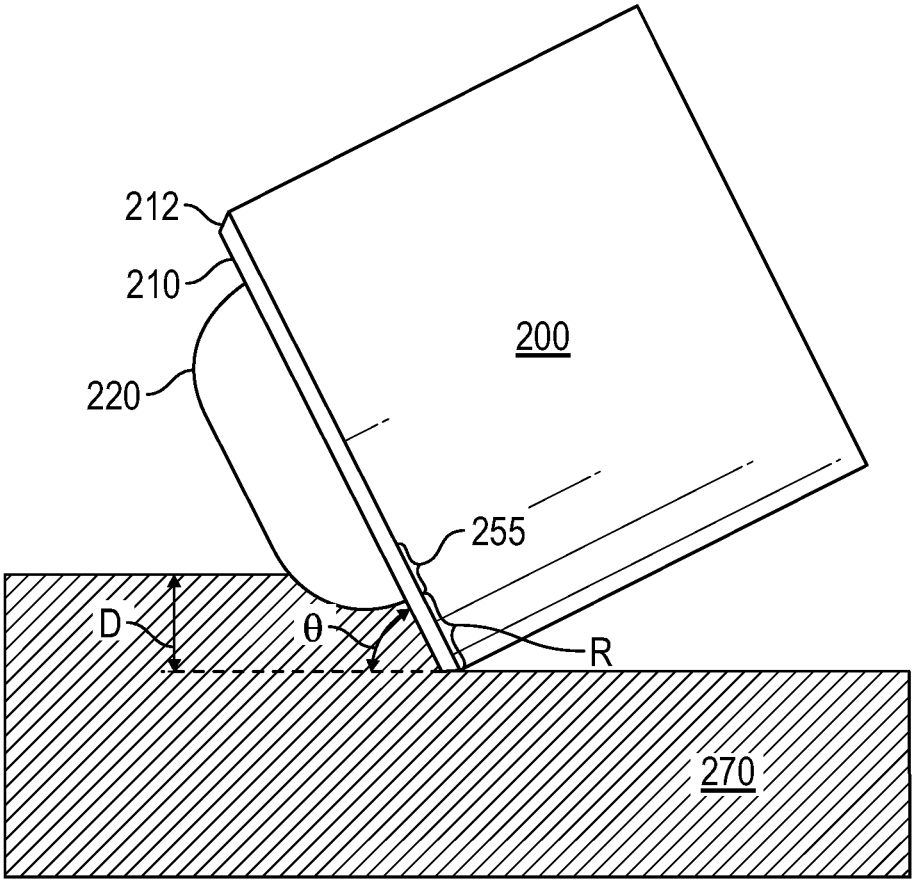
FIG. 14 shows a side view of a cutting element cutting a formation according to embodiments of the present disclosure.

For example, FIG. 14 shows a side view of a cutting element 200 according to embodiments of the present disclosure cutting a formation 270 at a depth of cut D. The cutting element 200 has a cutting face geometry including a protrusion 220 protruding from a lower portion 210 and spaced apart from the edge 212 of the cutting face, where the lower portion 210 extends a radial distance R between the edge 212 and the protrusion 220. The cutting element 200 shown in FIG. 14 includes a lower portion 210 extending entirely around the protrusion 220 and extending a uniform radial distance R from the edge 212. However, as discussed above, a lower portion may extend different radial distances around the cutting edge.

Along at least a portion of the cutting edge 212 designed to contact a working surface, the radial distance R of the lower portion 210 may be small enough that part of the protrusion 220 contacts the working surface at a particular depth of cut D. For example, when the cutting element 200 contacts a working surface of a formation 270 at contact angle θ and at a depth of cut D, the lower portion 210 around the portion of the edge 212 contacting the formation may extend a radial distance R less than the depth of cut divided by sin(contact angle), as shown in the following equation: $R<D/\sin(\theta)$.

Figure 15:
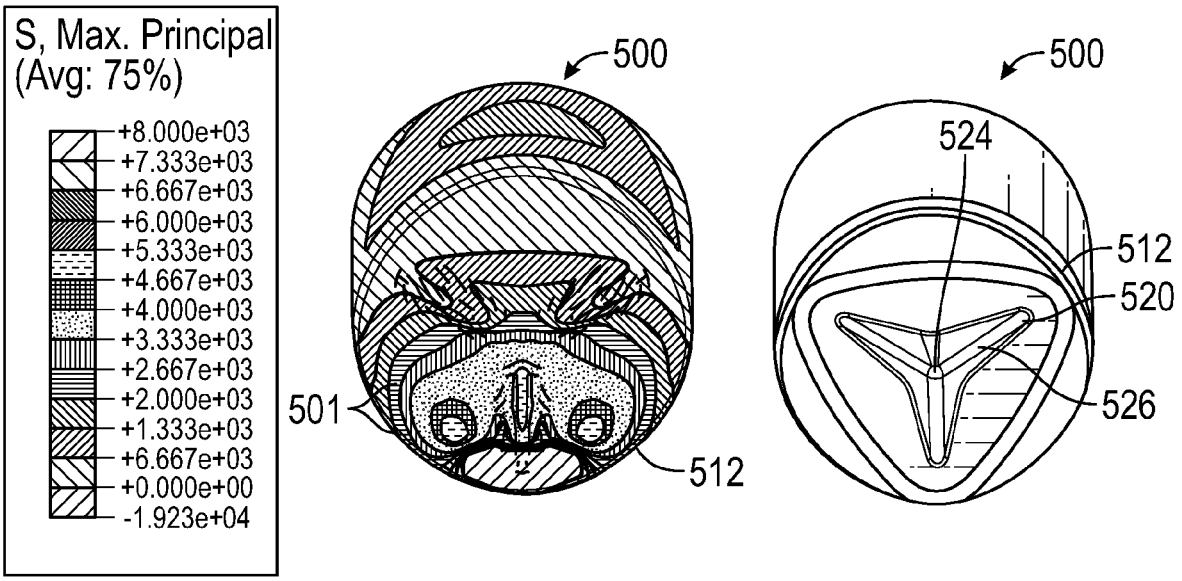
FIGS. 15 and 16 show finite element analysis comparing stress accumulation in a cutting element according to embodiments of the present disclosure (FIG. 15) to stress accumulation in a comparison cutting element (FIG. 16) under same conditions.
Figure 16:
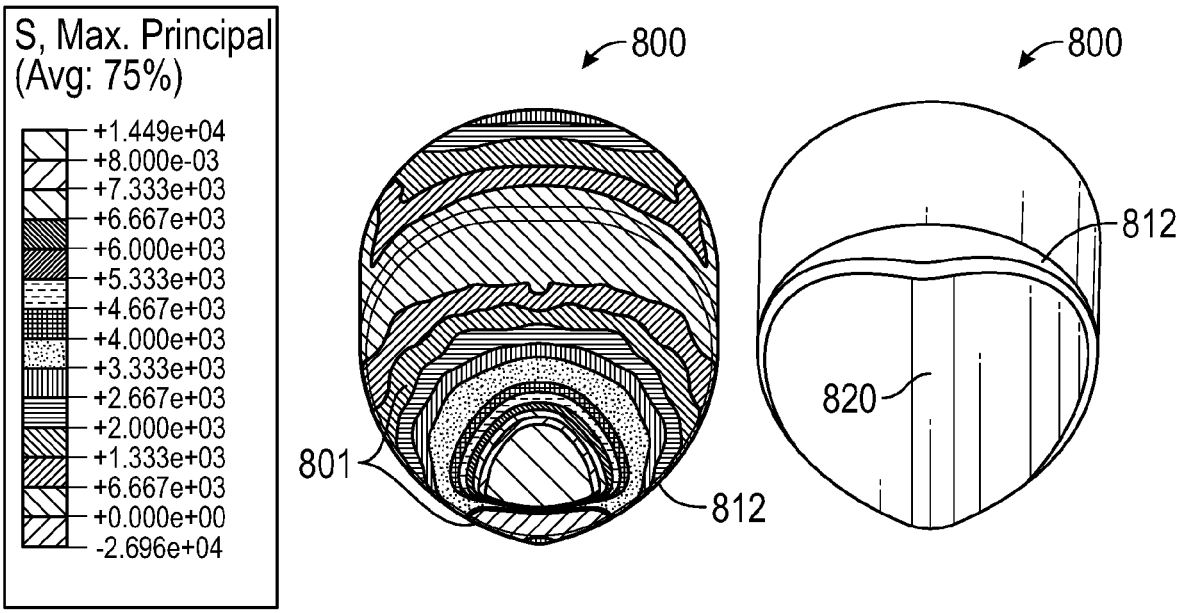

By spacing the protruding portion of the cutting face a radial distance away from the cutting edge, the maximum stress on the cutting face may be reduced. For example, FIGS. 15 and 16 show a finite element analysis comparing the stress accumulated along a cutting face of two different cutting elements impacting a rock formation at the same speed and same depth of cut. The cutting element 500 simulated in FIG. 15 has a cutting face geometry according to embodiments of the present disclosure, and as also shown in FIG. 8, where a protrusion 520 (having the shape of three intersecting ridges 526 joined together at an apex 524) is spaced apart from the cutting edge 512. The cutting element 800 simulated in FIG. 16 has a cutting face geometry including a protrusion 820 that extends to the cutting edge 812. As shown, less stress is accumulated near and around the cutting edge 512 on the cutting element 500 in FIG. 15 (where stress accumulation is indicated by bracket 501) than on the cutting element 800 in FIG. 16 (where stress accumulation is indicated by bracket 801).

Figure 17:
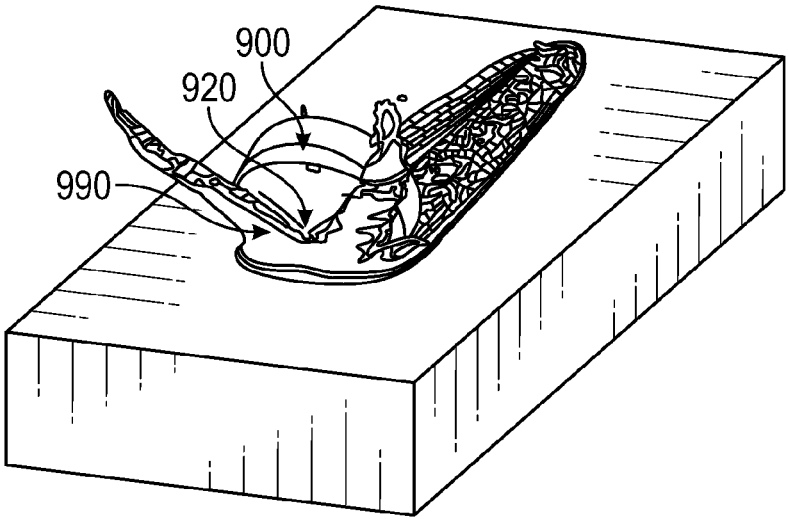
FIGS. 17 and 18 show finite element analysis comparing cutting action of a cutting element according to embodiments of the present disclosure (FIG. 17) to cutting action of a comparison cutting element (FIG. 18) under same conditions.
Figure 18:
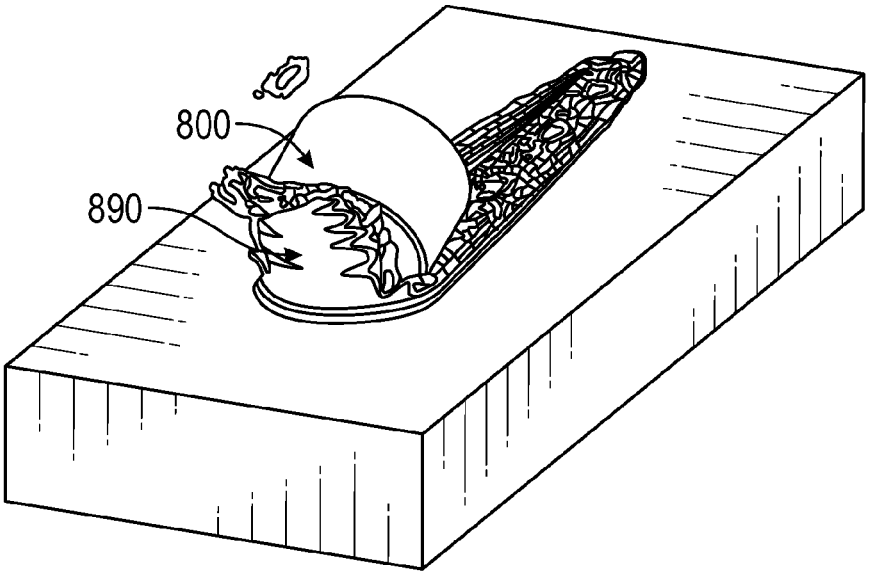

Another advantage of cutting face geometry having a space between the cutting edge and at least one protrusion, as described herein, includes improved cutting efficiency. For example, FIGS. 17 and 18 show simulations comparing cutting action of a cutting element 900 according to embodiments of the present disclosure and a cutting element 800 (as shown in FIG. 16) having a protrusion (shown in FIG. 16 as 820) extending to the cutting edge (shown in FIG. 16 as 812), respectively. As shown in FIG. 17, when a protrusion is spaced apart from a cutting edge, as according to embodiments of the present disclosure, the protrusion 920 may act as a splitter to split or cleave a formation 990 being cut, which may improve the cutting efficiency. In contrast, a cutting element 800 having a protrusion (shown in FIG. 16 as 820) extending to the cutting edge, as shown in FIG. 18, may direct cuttings 890 forward, which may lead to accumulation of the cuttings 890 at the cutting face, and thereby reduce cutting efficiency.

INDUSTRIAL APPLICABILITY

This disclosure generally relates to devices, systems, and methods for cutting elements which may be mounted to drill bits or other cutting tools for drilling earthen formations. Cutting tools, such as drill bits, may include one or more cutting elements. According to embodiments of the present disclosure, a cutting tool may include a cutting element having a cutting face geometry designed to improve the durability of the cutting element and maintain higher rock cutting efficiency. The cutting face geometry may include at least one protrusion or ridge spaced apart from the edge of the cutting face, such that during operation, the protrusion(s) may apply stresses to fracture a formation, and the space apart from the edge may allow less stress to accumulate at the edge, thereby increasing durability of the edge.

In some embodiments, a cutting element may include a body having a base and a cutting end at opposite axial ends, and a cutting face formed at the cutting end. The cutting face includes at least one protrusion spaced a radial distance apart from an edge of the cutting element. The edge extends around an entire periphery of the cutting face. The cutting face includes a lower portion extending within the radial distance between the at least one protrusion and the edge. A lower portion axial height measured between the edge and a base of the at least one protrusion is less than 30 percent of a greatest axial height of the at least one protrusion measured between the base of the at least one protrusion and an axially highest point of the at least one protrusion. In some embodiments, the cutting element may include a chamfer formed interior to an extending around the edge of the cutting element, where an axial height of the chamfer is within the lower portion axial height. In some embodiments, the lower portion may include at least one planar surface extending along a plane perpendicular to a longitudinal axis of the cutting element. The lower portion may include at least one sloped surface extending axially and radially outward from the at least one planar surface toward the edge. In some embodiments, the cutting element may include a diamond table disposed on a substrate. The cutting face may be formed on the diamond table, and the substrate forms the base. In some embodiments, the at least one protrusion includes at least one ridge extending a length along the cutting face. In some embodiments, the at least one protrusion includes a pyramid having multiple sides extending from a polygonal base shape to an apex. In some embodiments, the at least one protrusion includes a rounded top. In some embodiments, the at least one protrusion includes multiple ridges joined together at an apex, where the apex is the axially highest point of the at least one protrusion. In some embodiments, the radial distance is at least 5 percent of a cutting face diameter at a point where the at least one protrusion is closest to the edge. In some embodiments, the at least one protrusion is axisymmetric about a longitudinal axis. In some embodiments the at least one protrusion includes three or more protrusions. In some embodiments, the cutting face includes a planar surface at a longitudinal axis of the cutting element. In some embodiments, the axially highest point of the at least one protrusion is at a longitudinal axis of the cutting element. In some embodiments, the cutting element includes a chamfer formed interior to and extending around the edge of the cutting element, where a chamfer slope of the chamfer relative to a longitudinal axis of the cutting element is greater than a protrusion slope In some embodiments, a cutting element includes a body, a diamond table disposed at a cutting end of the body, and a cutting face formed on the diamond table at the cutting end. The cutting face includes a geometry having a planar portion and at least one protrusion raised from the planar portion. The planar portion entirely surrounds the at least one protrusion. In some embodiments, the planar portion extends along a plane perpendicular to a longitudinal axis of the cutting element. In some embodiments, the cutting element includes at least one sloped surface extending from the planar portion toward an edge of the cutting face at a slope with respect to a longitudinal axis of the cutting element. In some embodiments, the at least one protrusion includes a pyramid having multiple sides extending from a polygonal base shape to an apex. In some embodiments, the at least one protrusion includes a rounded top. In some embodiments, the planar portion extends from the at least one protrusion to an edge of the cutting face. In some embodiments, the cutting element includes a chamfer formed interior to and extending around an edge of the cutting face, wherein the planar portion is between the chamfer and the at least one protrusion. In some embodiments, the at least one protrusion is spaced a distance apart from an edge of the cutting face, wherein the distance is greater than 5 percent of the cutting face diameter.

In some embodiments, a cutting element includes a body having a base and a cutting end at opposite axial ends, a cutting face formed at the cutting end, and a chamfer formed around the periphery of the cutting face. The cutting face includes at least one protrusion spaced a radial distance apart from an inner diameter of the chamfer. In some embodiments, the radial distance is greater than a radial distance of the chamfer. In some embodiments, the at least one protrusion is axisymmetric about a longitudinal axis of the cutting element.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A cutting element comprising:

a body having a base and a cutting end at opposite axial ends, wherein a substrate forms the base, and a diamond table disposed on the substrate forms the cutting end;

a cutting face formed on the diamond table, the cutting face comprising:

at least one protrusion spaced a radial distance apart from an edge of the cutting element such that a center axis of the at least one protrusion is offset from an axial center of the cutting face and wherein the radial distance varies around the cutting edge where at least a first portion is between 2 and 10% of the cutting face diameter and at least a second portion is between 20% and 80% of the cutting face diameter, the edge extending around an entire periphery of the cutting face, wherein the at least one protrusion comprises at least one ridge extending a length along the cutting face; and a lower portion extending within the radial distance between the at least one protrusion and the edge;

wherein a lower portion axial height measured between the edge and a base of the at least one protrusion is less than 30 percent of a greatest axial height of the at least one protrusion measured between the base of the at least one protrusion and an axially highest point of the at least one protrusion.

2. The cutting element of claim 1, further comprising a chamfer formed interior to and extending around the edge of the cutting element, wherein an axial height of the chamfer is within the lower portion axial height.

3. The cutting element of claim 1, wherein the lower portion comprises at least one planar surface extending along a plane perpendicular to a longitudinal axis of the cutting element.

4. The cutting element of claim 3, wherein the lower portion further comprises at least one sloped surface extending axially and radially outward from the at least one planar surface toward the edge.

5. The cutting element of claim 1, wherein the at least one protrusion comprises multiple ridges joined together at an apex, and wherein the apex is the axially highest point of the at least one protrusion.

6. The cutting element of claim 1, wherein the at least one protrusion comprises a pyramid having multiple sides extending from a polygonal base shape to an apex.

7. The cutting element of claim 1, wherein the at least one protrusion comprises a rounded top.

8. The cutting element of claim 1, wherein the radial distance is at least 5 percent of a cutting face diameter at a point where the at least one protrusion is closest to the edge.

9. The cutting element of claim 1, wherein the at least one protrusion comprises three or more protrusions.

10. The cutting element of claim 1, wherein the cutting face comprises a planar surface at a longitudinal axis of the cutting element.

11. The cutting element of claim 1, wherein the axially highest point of the at least one protrusion is at a longitudinal axis of the cutting element.

12. The cutting element of claim 1, comprising a chamfer formed interior to and extending around the edge of the cutting element, wherein a chamfer slope of the chamfer relative to a longitudinal axis of the cutting element is greater than a protrusion slope between the base and the axially highest point of the at least one protrusion.

13. A cutting element comprising:

a body;

a diamond table disposed at a cutting end of the body; and a cutting face formed on the diamond table at the cutting end, the cutting face having a geometry comprising:

a planar portion extending along a plane perpendicular to a longitudinal axis of the cutting element;

at least one protrusion raised from the planar portion, such that a center axis of the at least one protrusion is offset from an axial center the cutting face;

at least one sloped surface extending from the planar portion toward an edge of the cutting face at a slope with respect to the longitudinal axis of the cutting element;

wherein the planar portion entirely surrounds the at least one protrusion;

and wherein the edge of the cutting face is spaced a radial distance from the at least one protrusion such that the radial distance varies around the cutting edge where at least a first portion is between 2% and 10% of the cutting face diameter and at least a second portion is between 20% and 80% of the cutting face diameter.

14. The cutting element of claim 13, wherein the at least one protrusion comprises a pyramid having multiple sides extending from a polygonal base shape to an apex.

15. The cutting element of claim 13, wherein the at least one protrusion comprises at least one ridge extending a length along the cutting face.

16. The cutting element of claim 15, wherein the at least one ridge comprises multiple ridges extending the length, and the planar portion extends across the longitudinal axis and surrounds the multiple ridges.

17. The cutting element of claim 13, wherein the at least one protrusion comprises a rounded top.

18. The cutting element of claim 13, comprising a chamfer formed interior to and extending around the edge of the cutting face, wherein the planar portion is between the chamfer and the at least one protrusion, wherein a cutting element height at the edge closest to the at least one protrusion is greater than the cutting element height at the edge interface with the at least one sloped surface.

19. The cutting element of claim 13, wherein the at least one protrusion is spaced a distance apart from the edge of the cutting face, wherein the distance is greater than 5 percent of the cutting face diameter.

* * * * *